US007364041B2

(12) United States Patent
Roesler

(10) Patent No.: US 7,364,041 B2
(45) Date of Patent: Apr. 29, 2008

(54) CASE WITH LENGTH STOP

(76) Inventor: Peter Roesler, Ifenweg 3, D-88239 Wangen/Allgäu (DE)

( * ) Notice: Subject to any disclaimer, the term of this patent is extended or adjusted under 35 U.S.C. 154(b) by 0 days.

(21) Appl. No.: 11/340,281

(22) Filed: Jan. 26, 2006

(65) Prior Publication Data

US 2006/0169613 A1 Aug. 3, 2006

(30) Foreign Application Priority Data

Jan. 28, 2005 (DE) ..... 20 2005 001 405 U

(51) Int. Cl.
*B65D 85/24* (2006.01)

(52) U.S. Cl. ..... 206/379; 206/373

(58) Field of Classification Search ..... 206/372–379, 206/743, 745, 747–749, 806, 443
See application file for complete search history.

(56) References Cited

U.S. PATENT DOCUMENTS

| | | | | |
|---|---|---|---|---|
| 2,526,732 | A | 10/1950 | Cogsdill | |
| 2,775,342 | A * | 12/1956 | Smith | 206/379 |
| 2,792,935 | A * | 5/1957 | Rocchetti | 206/379 |
| 4,660,719 | A * | 4/1987 | Peterson et al. | 206/379 |
| 4,773,536 | A * | 9/1988 | Rau | 206/379 |
| 5,562,208 | A * | 10/1996 | Hasler et al. | 206/373 |
| 6,283,291 | B1 * | 9/2001 | Vasudeva et al. | 206/373 |
| 6,547,077 | B1 * | 4/2003 | Budert | 206/379 |
| 6,994,214 | B2 * | 2/2006 | Yang | 206/379 |

FOREIGN PATENT DOCUMENTS

| | | |
|---|---|---|
| DE | GM 77 21 646 | 1/1979 |
| DE | U 81 35 902.0 | 4/1982 |
| DE | G 88 12 791.5 | 1/1989 |
| DE | 40 06 782 A1 | 9/1991 |
| EP | 0 445 372 B1 | 11/1990 |

* cited by examiner

*Primary Examiner*—Luan K Bui
(74) *Attorney, Agent, or Firm*—Frederick L. Tolhurst, Esq.; Cohen & Grigsby, P.C.

(57) ABSTRACT

A case for holding elongate objects, in particular, a case for holding drills or other elongate tools, comprising a housing shell having a lid hinged to the rear part thereof via a horizontal pivoting axis, wherein the elongate objects are held in one holding part or in a plurality of holding parts pivotably mounted in the housing shell, and wherein when the case is closed, the said elongate objects fill a holding space in the housing shell which holding space is limited in forward direction by a length stop disposed in the housing shell and combining with at least one stop rib to form the length stop for the elongate objects, wherein the length stop forms a holding space for additional objects to be kept therein.

6 Claims, 2 Drawing Sheets

CASE WITH LENGTH STOP

CROSS REFERENCE

This application claims priority to German Patent Application No. 20 2005 001 405.2 filed Jan. 28, 2005.

BACKGROUND OF THE INVENTION

1. Field of the Invention

The subject of the invention is a case with a length stop, in particular, a case for holding drills or other elongate tools.

Insofar as the present description of the invention mentions a "drill case", this is not to be understood as a restriction. The invention relates to a length stop for all cases suitable for holding elongate objects and having one or a plurality of holding parts for this type of elongate objects, wherein upon opening of the lid the case is automatically pivoted upwards to offer the objects for removal.

When the description of the later exemplary embodiments calls the elongate objects "drills", this is not to be understood as a restriction. The invention thus relates to all elongate objects suitable to be kept in a case of this type.

2. Description of the Prior Art

Known to the art is the possibility of providing the interior of a case with a so-called adjustable length stop comprising an adjustable plate capable of being displaced and set in different snap-on or bracing stages in the direction of the longitudinal axis of the case.

Here, a stop rib in a shape corresponding approximately to the pointed contours of the inserted tools, in particular, of the inserted drills to be braced therein, is attached to the length stop.

The arrangement of the length stop ensures that the tips of the drills can no longer be substantially displaced in longitudinal direction, which prevents an undesirable longitudinal displacement clearance for the drills inserted in the compartments of the holding parts, while the case is in closed position.

An adjustable length stop of this type has proven itself. It was now found that the interior space of the case can also be used to hold additional objects.

The invention therefore relates to the object of refining a case with a length stop in such a way that a further bracing space for additional objects is created.

The stated object is achieved according to the invention as characterized by the enabling disclosure of claim 1.

Advantageous refinements of the subject of claim 1 are the subject of the subclaims.

An essential feature of the invention lies in the fact that now an additional holding space is proposed in the area of the length stop, namely, on the other side of the aforementioned stop rib.

This means that the pointed contours of the drills inserted in the holding parts are made use of by mounting the length stop in such a way that it corresponds to the said pointed contours.

The space remaining on the length stop on the other side of the stop rib now can be used as holding space for additional objects to be kept therein according to the invention.

In this context, there is a plurality of possibilities of keeping objects of this type in the said space. It is possible to create clamping devices or compartments into which the additional objects are loosely inserted.

Additional objects of this type can, for example, be a magnifying glass, a small oilcan, a countersinker, a metal measuring rod, or other accessories appropriately matched to the tools inserted earlier in the compartments of the holding parts.

SUMMARY OF THE INVENTION

The subject of the present invention ensues not only from the subject of the individual patent claims, but also from the combination of the individual patent claims with one another.

All data and features disclosed in the documentation, including the abstract, in particular, the spatial structure represented in the drawings, are claimed as substantial for the invention insofar as they are novel individually or in combination as compared to the prior art.

BRIEF DESCRIPTION OF THE DRAWINGS

The invention is explained in detail herebelow with reference to drawings representing only one way of carrying out the invention. In this context, additional substantial features and advantages of the invention become evident from the drawings and their descriptions.

DESCRIPTION OF A PRESENTLY PREFERRED EMBODIMENT OF THE INVENTION

Figures 1, 2:
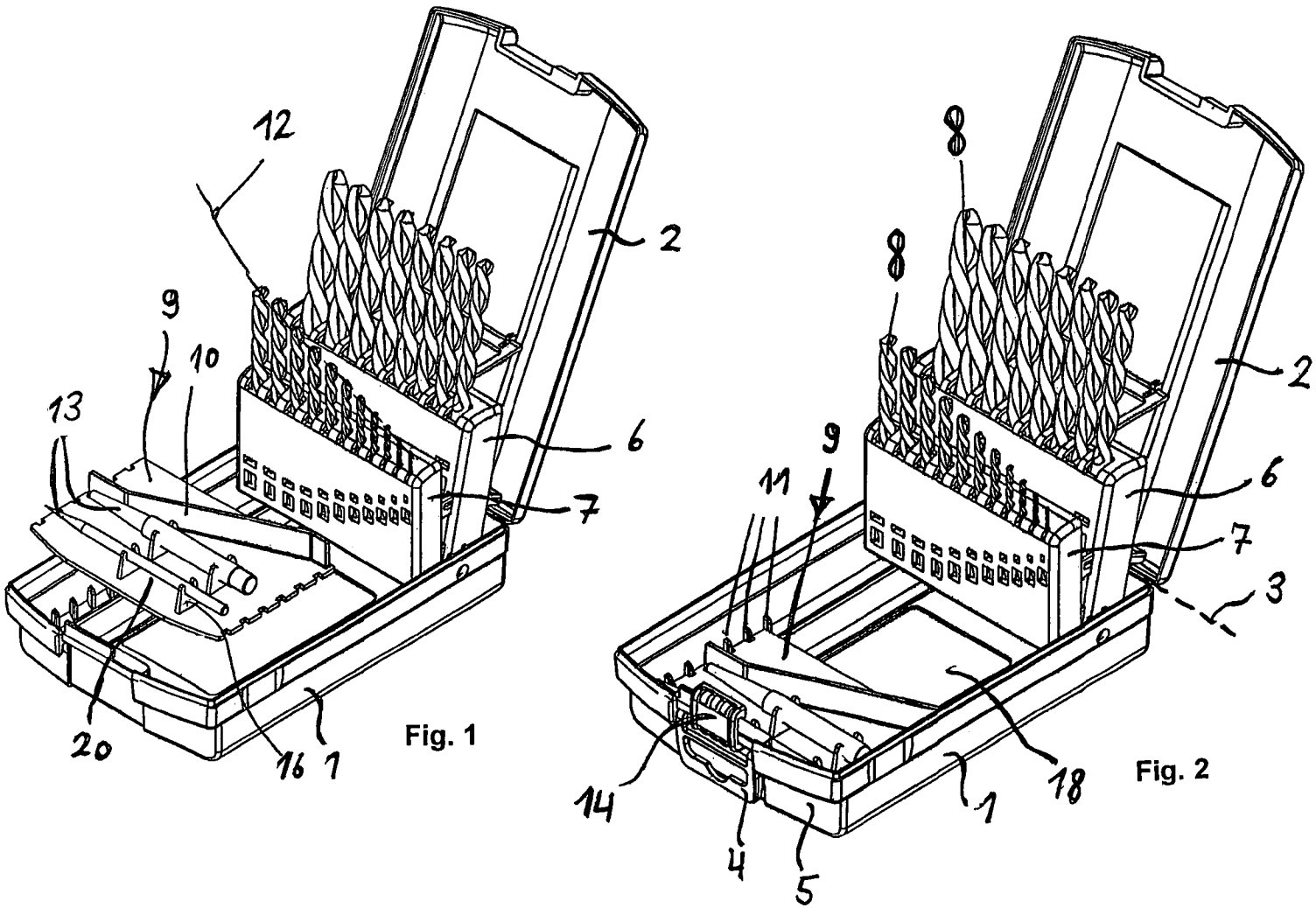
FIG. 1: shows a schematic perspective view of a case according to the invention with removed length stop.
FIG. 2: shows the representation of FIG. 1 with inserted length stop.

The case according to FIG. 1 is manufactured of all-plastics material, wherein an ABS material is preferably used as material for the housing shell 1 and the lid 2, while a propylene is used for the holding parts 6, 7. D The use of all-plastics material for all components leads to the additional important aspect that this kind of a completely filled drill case may drop from a height of two meters onto hard ground without incurring damage to the housing, the content, or the holding parts 6, 7.

Due to the use of a special slide closure 14 between the lid and the housing shell, coincidentally, an unintended opening of the lid 2 is prevented in this extreme example, as well.

The lid 2 is hinged to the rear side of the housing shell 1 by means of two hinges disposed in parallel in such a way that the said lid can be pivoted in a pivoting axis 3.

A pivotable hanging hook 4 is disposed on the frontal end wall 5 below the slide closure 14.

The drills 8 inserted in the compartments of the holding parts 6, 7 now form pointed contours 12 with their tips, and in order to prevent the said drills from being displaced longitudinally, a length stop 9 is disposed in the holding space 18 of the housing shell 1 in such a way that it can be longitudinally displaced and set.

Figure 3:
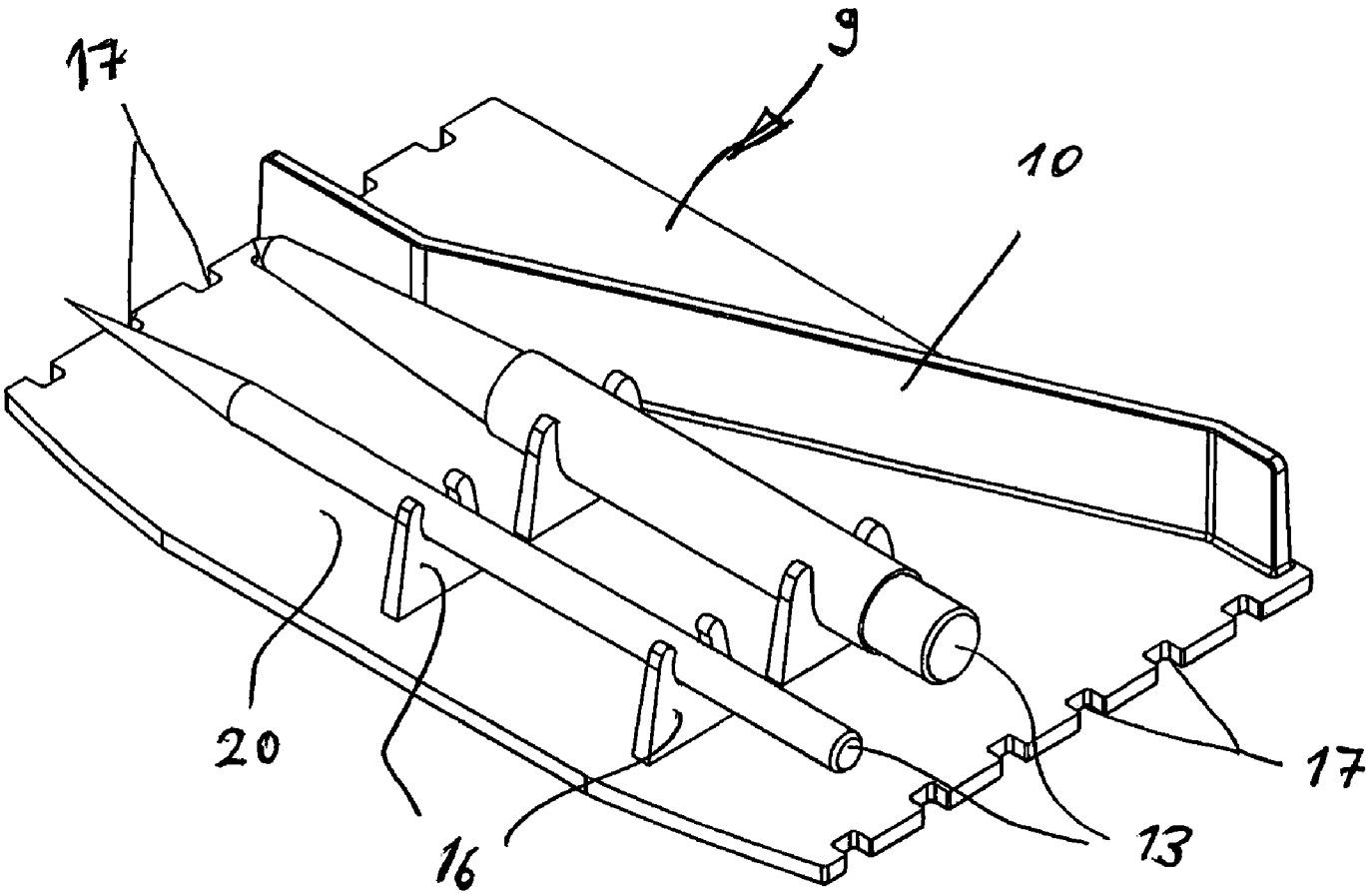
FIG. 3: shows a length stop according to FIGS. 1 and 2 in perspective representation.

For this purpose, indentations 17 corresponding to matching ribs 11 disposed on the floor of the housing shell 1 on the left and the right sides are disposed on the lateral edges of the length stop according to FIG. 3.

Corresponding to the limitation of the length stop and the pointed contours 12 of the inserted drills 8, the length stop 9 is therefore arrested in a certain displacement position in the holding space 18 due to the fact that the indentations 17 are snapped onto the ribs 11.

The stop rib 10 on the length stop 9 now replicates the pointed contours 12, while the lower layer of the drills 8 in the holding part 6 comes to rest on the opposite side to the stop rib 10.

According to the invention, the possibility is provided of using the holding space 20 on the other side of the stop rib 10 for bracing additional objects 13.

In the exemplary embodiment shown, snap-on devices 16 are provided for bracing the objects 13 by a snap-on mechanism.

However, the invention is not limited to this. Aside from the snap-on devices or instead of the snap-on devices, open compartments and other bracing organs for bracing any objects 13 may be provided.

The height of the objects 13 should as far as possible not exceed the height of the stop rib 10 insofar as the drills 8 disposed in the rear holding part 6 reach all the way to the interior of the frontal end wall 5 of the housing shell 1.

It is of course also possible to provide that the stop rib 10 of the length stop 9 be designed with greater height, in order to thereby construct a length stop for the drills 8 in the lower holding part 7 as well as in the upper holding part 6.

LEGEND FOR THE DRAWINGS 1 housing shell
2 lid
3 pivoting axis
4 hanging hook
5 end wall
6 holding part
7 holding part
8 drill
9 length stop
10 stop rib
11 rib
12 pointed contours
13 object
14 slide closure
15
16 snap-on device
17 indentation
18 holding space (housing shell
19
20 holding space (length stop)

What is claimed is:

1. A case for holding elongate objects, said case comprising:

a housing shell having a floor that is bordered by right and left sides;

a lid that is pivotally hinged to the rear part of said housing shell via a horizontal pivoting axis;

at least one holding part for holding the elongate objects, said holding part being pivotally mounted in said housing shell;

a plate that is removably connected to the housing shell, said plate incorporating at least one stop rib that defines the forward boundary of a first holding space for elongate objects in the housing shell at times when said lid is in a closed position against said housing shell, said plate cooperating with said at least one stop rib and with the right and left sides of said housing shell to define a second holding space that is located on the opposite side of the stop rib from said first holding space, said plate being connectable to said housing shell at different longitudinal positions within said housing shell so that the size of the second holding space can be adjusted by longitudinally adjusting the location of the plate within the housing shell; and devices that are connected to said plate, said devices being capable of securing objects within the second holding space.

2. A case according to claim 1 wherein the plate includes snap-on devices for holding said objects.

3. A case according to claims 1 or 2 wherein the plate defines at least one compartment within said second holding space for said objects.

4. A case according to one of claims 1 or 2 wherein the elongate objects within the first holding space have pointed contours, the stop rib of said plate being adapted to the pointed contours of the elongate objects and wherein space on the plate that is not filled by the elongate objects within the first holding space is included in the second holding space for objects to be kept on the plate.

5. A case according to one of claims 1 or 2 wherein the second holding space for the objects to be kept on the plate receives objects that are stored in two layers.

6. A case for holding elongate objects, said case comprising:

a housing shell that includes a floor and a plurality of ribs are disposed on said floor;

a lid that is pivotally hinged to the rear part of said housing shell via a horizontal pivoting axis;

at least one holding part for holding the elongate objects, said holding part being pivotally mounted in said housing shell; and a plate that is removably connected to the housing shell, said plate having lateral indentations that engage with the ribs that are disposed on the floor of said housing shell, said plate engaging said ribs at different longitudinal positions within said housing shell so that location of the plate can be longitudinally adjusted within the housing shell, said plate incorporating at least one stop rib that defines the forward boundary of a first holding space for elongate objects in the housing shell at times when said lid is in a closed position against said housing shell, said plate cooperating with said at least one stop rib to define a second holding space on the opposite side of the stop rib from said first holding space, said plate being connectable to said housing shell at different longitudinal positions within said housing shell so that location of the plate can be longitudinally adjusted within the housing shell, said plate including devices within the second holding space for securing objects therein.

* * * * *